US005273515A

United States Patent [19]

Fenske

[11] Patent Number: 5,273,515

[45] Date of Patent: Dec. 28, 1993

[54] TRANSPORTING ARRANGEMENT FOR TRANSFERRING OF TRANSVERSELY FOLDED PRINTED PRODUCTS TO THIRD FOLD

[75] Inventor: Horst Fenske, Leipzig, Fed. Rep. of Germany

[73] Assignee: Zirkon Druckmaschinen GmbH, Leipzig, Fed. Rep. of Germany

[21] Appl. No.: 918,263

[22] Filed: Jul. 22, 1992

[30] Foreign Application Priority Data

Aug. 1, 1991 [DE] Fed. Rep. of Germany ..... 4125465

[51] Int. Cl.[5] ..... B65H 45/16; B65H 45/18

[52] U.S. Cl. ..... 493/416; 493/357; 493/425; 493/437

[58] Field of Search ..... 493/416, 436, 437, 444, 493/445, 425, 357; 270/21.1, 44

[56] References Cited

U.S. PATENT DOCUMENTS

| | | | |
|---|---|---|---|
| 191,494 | 2/1877 | Tucker | 493/425 |
| 1,871,900 | 8/1932 | Mentges | 493/444 |
| 3,999,454 | 12/1976 | Tiso | 270/21.1 |
| 4,269,402 | 5/1981 | Fischer | 493/437 |
| 4,746,107 | 5/1988 | Schneider | 270/21.1 |
| 4,754,959 | 7/1988 | Kobler | 270/21.1 |
| 4,869,712 | 9/1989 | Ishino | 493/416 |
| 5,045,039 | 9/1991 | Bay | 493/23 |

FOREIGN PATENT DOCUMENTS 2750792 5/1979 Fed. Rep. of Germany .

*Primary Examiner*—Bruce M. Kisliuk
*Assistant Examiner*—Jack Lavinder
*Attorney, Agent, or Firm*—Michael J. Striker

[57] ABSTRACT

An arrangement for transferring transversely folded printed products to a third fold has a mechanism for providing a first longitudinal fold, a subsequently arranged mechanism for forming a transverse fold and having an outlet gap, two devices for forming a third fold, located one above the other and each having an inlet gap, two drawing-in roller pairs associated with a respective one of the devices and each having a central axis located in one imaginary vertical plane. The inlet gaps of the devices for forming a third fold and the outlet gap of the mechanism for forming a transverse fold are arranged relative to one another so that an imaginary horizontal plane extending through the outlet gap is simultaneously a plane of symmetry for the inlet gaps. A mechanism for connecting the outlet gap with the inlet gaps and includes a first transporting roller pair, a product deflector and two mirror-symmetrical sheet guides of a same length. The sheet guides have a harmonic course and are each provided with two spaced transporting roller pairs arranged so that a distance between the further transporting roller pairs and a distance between a last one of the further transporting roller pairs and the drawing-in roller pair is smaller than the length of a product to be folded. The further transporting roller pairs and the drawing-in roller pair have speeds which harmonically decrease in a transporting direction.

8 Claims, 2 Drawing Sheets

TRANSPORTING ARRANGEMENT FOR TRANSFERRING OF TRANSVERSELY FOLDED PRINTED PRODUCTS TO THIRD FOLD

BACKGROUND OF THE INVENTION

The present invention relates to a transporting arrangement for transferring transversely folded printed products to a third fold, as used in a folding apparatus for fast roller rotary printing machines.

Various transporting arrangements for transferring of transversely folded printed products to a third fold are known. The known transporting arrangements can be subdivided into two types. In the arrangement of the first type the splitting of the product stream into two partial streams of the same thickness is performed directly at the folding cylinder of the transverse fold device, so that the transversely folded printed products are taken by the folding cylinder at two points. The conveying routes are provided with different lengths and with regard to a speed reduction for the products to have different dimensions. An arrangement of this type is disclosed for example in the German document DE-AS 2,750,792.

In the arrangements of the second type the transversely folded printed products are taken at a single point of the folding cylinder of the transverse folding device so that two partial streams of transversely folded printed products are produced by subsequent alternatingly controlled product deflectors, and then both devices for forming a third fold act on the product streams. The arrangements of the second type are disclosed for example in the German document DE-OS 3,527,710 and have transporting routes which are bent many times and provided with conveyor guides. Only because of the expensive conveyor guides which transport the product positively by positive engagement with the conveyor, the acceleration jams at the unstable points of the conveying route are avoided which otherwise would worsen the position accuracy of the products. A subsequent position correction by abutments in cooperation with the conveyor guides inside the devices for forming a third fold is connected with a long scraping of the freshly printed products between the conveyors thus causing smearing danger. The squeezing of the products during abrupt direction changes of the conveying route negatively influences the folding quality of the sensitive products.

SUMMARY OF THE INVENTION

Accordingly, it is an object of the present invention to provide a transporting arrangement for transferring transversely folded printed products to a third fold, which avoids the disadvantages of the prior art.

In keeping with these objects and with others which will become apparent hereinafter, one feature of the present invention resides, briefly stated, in a transporting arrangement in which the devices for forming a third fold are arranged vertically one above the other, inlet gaps of both devices for forming a third fold and an outlet gap of a product discharge of a transverse fold device are arranged relative to one another so that an imaginary plane extending horizontal in the outlet gap is simultaneously a plane of symmetry for the inlet gaps, the outlet gap of the product discharge of the transverse folding device is connected with the inlet gaps of both devices for forming a third fold through a first transporting roller pair, a product deflector and two mirror-symmetrical sheet guides of the same length, the geometry of the sheet guides has a harmonically course, and the sheet guides each have partially further transporting roller pairs, wherein the portion length between the subsequent transporting roller pairs and between the last transporting roller pair and the drawing-in roller pair of both devices for forming a third fold is smaller by a predetermined amount than the folding product length, and the peripheral speeds of the transporting roller pairs in the sheet guides as well as the drawing-in roller pair in the transporting direction are harmonically decreasing.

When the arrangement is designed in accordance with the present invention, the product stream extending from a single product discharge is subdivided into two partial streams of the same thickness and the partial streams are supplied to the subsequent parallel operating devices for forming a third fold in such a manner that the mechanical load of the products during the conversion is extremely low, the position accuracy of the discharge product during the conversion is retained, and the product quantity per time unit as well as the product speed are adjusted to the maximum processing speed of the device for forming a third fold.

In accordance with another feature of the present invention the geometry of the sheet guides have the course of a sinus portion between two following apexes.

The sheet guides can have each a second and a third transporting roller pair, and a peripheral speed of the second transporting roller pair, the third transporting roller pair and the drawing-in roller pair with respect to the first transporting roller pair is maintained within the ratio of 1/1.3:1; 1/2:1; 1/3:1.

The sheet guides can have a lower and an upper guiding grid with a guiding rail extending in a transporting direction, and the width of the gap between the upper and lower guiding grids is greater than the thickness of the product stream.

The above mentioned guiding grids can be turnable upwardly and downwardly.

The product deflector can be composed of two turnable units each having two spaced guiding sheets, and each unit can be yieldable against the pressure force of a pressure spring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
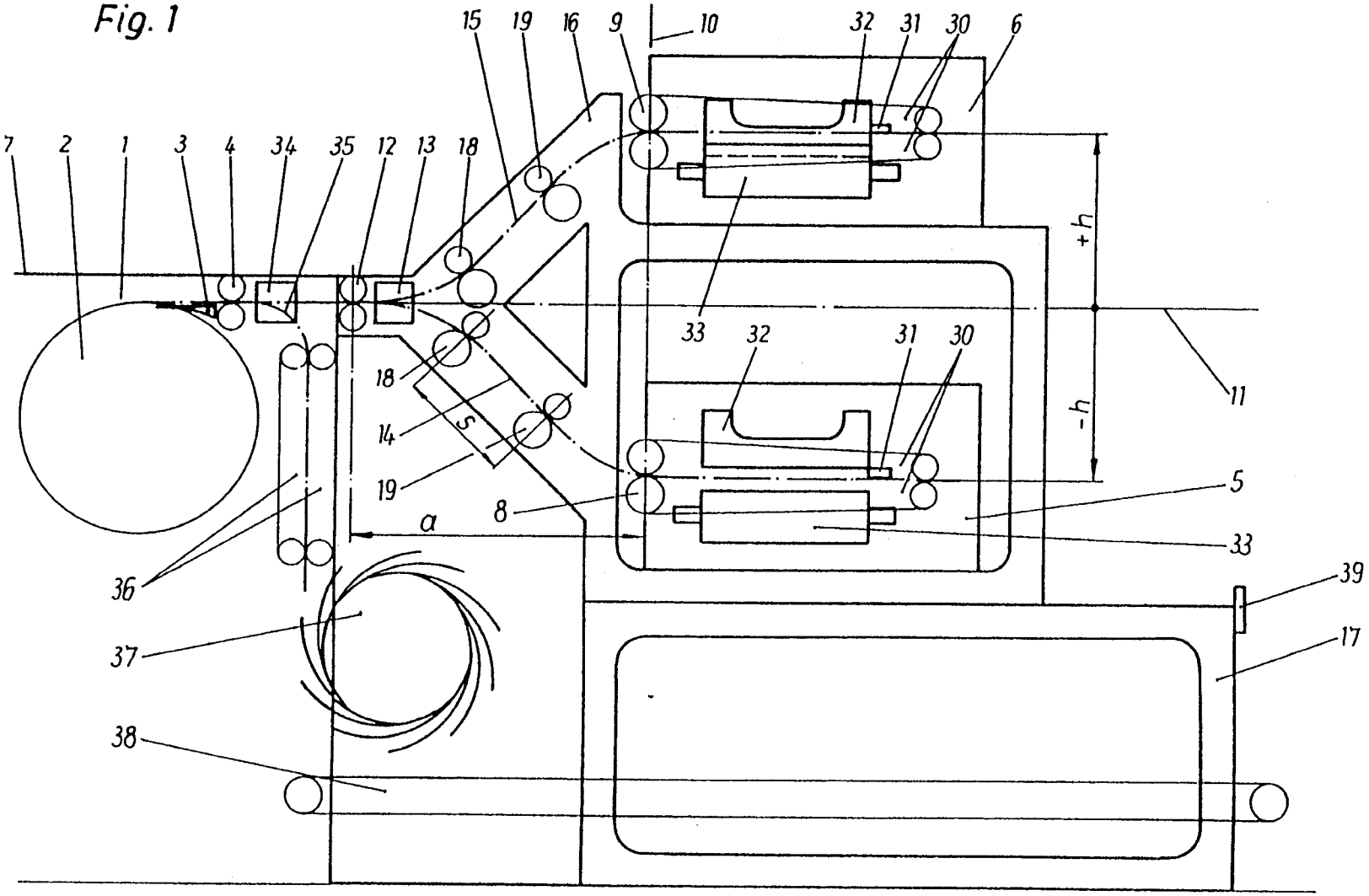
FIG. 1 is a view schematically showing the inventive transporting arrangement with a product discharge of a transverse fold device and two additional folding apparatuses arranged one above the other for a longitudinal fold (third fold) as well as an additional discharge of the second fold, on a side view.
Figure 2:
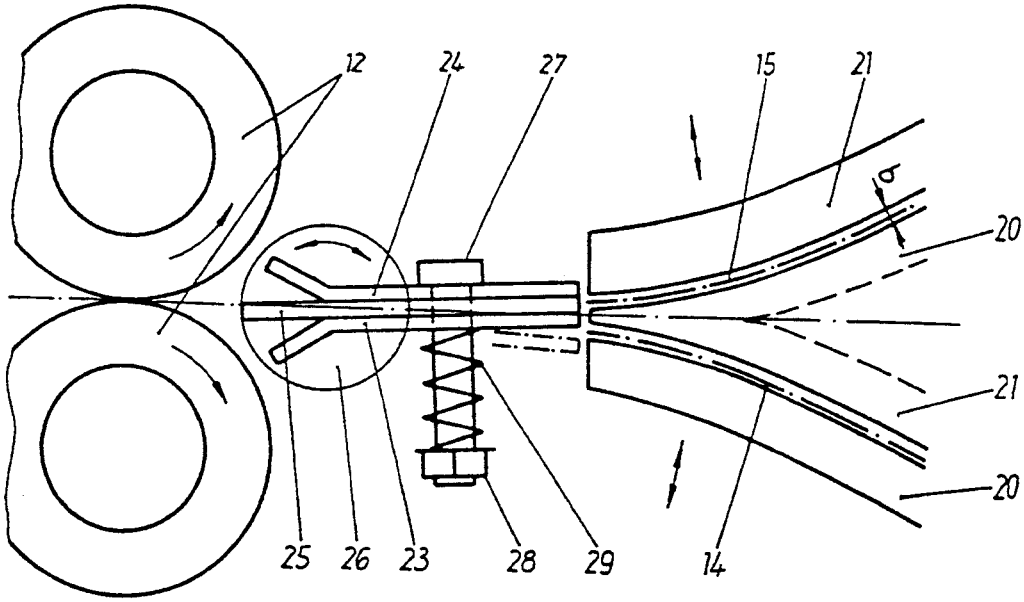
FIG. 2 is a view schematically showing a product deflector of the inventive transporting arrangement on a side view.
Figure 3:
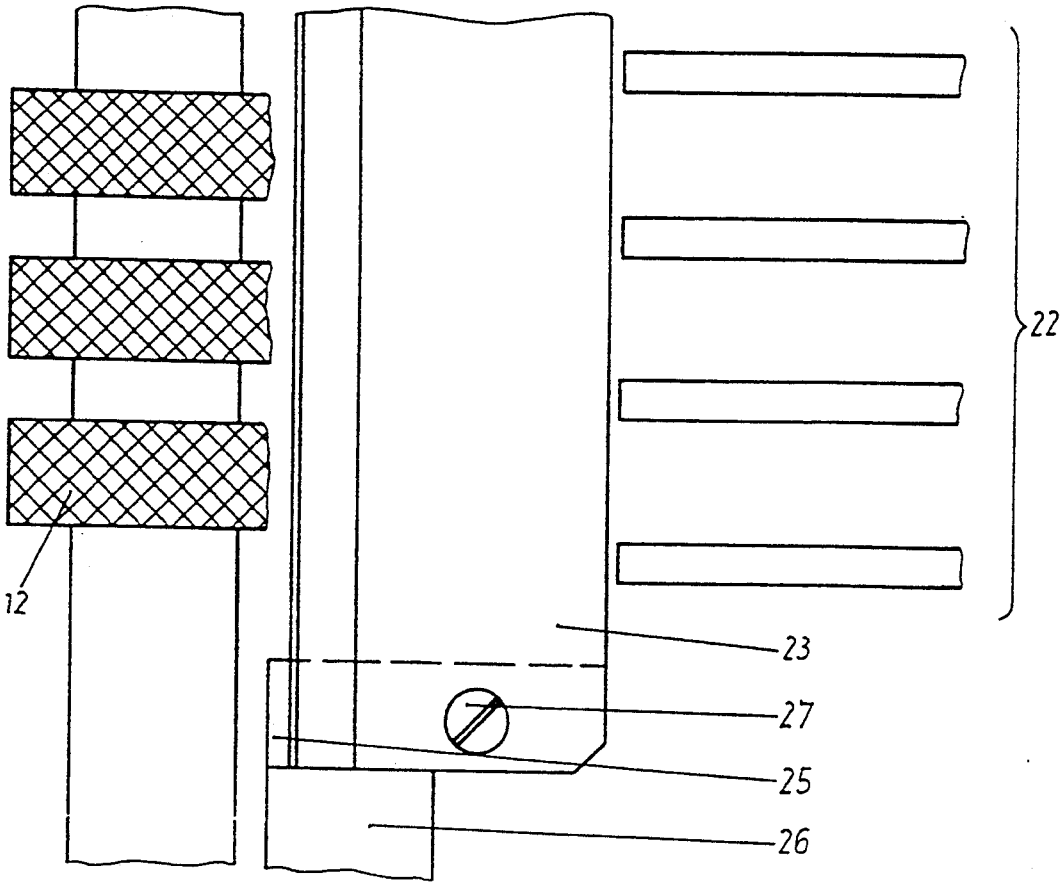
FIG. 3 is a view showing the product deflector of the inventive transporting arrangement on a plan view.

A transporting arrangement for transferring transversely folded products to a third fold in accordance with the present invention includes a transverse folding device 1 with a folding cylinder 2, discharge tongues 3 and a drawing roller pair 4. Two devices forming a third fold are arranged over one another and operate parallel, and two additional folding apparatuses 5 and 6 for a second longitudinal fold are arranged after the transverse fold device 1.

The folding cylinder 2, the discharge tongues 3 and the drawing roller pair 4 cooperate with one another and perform the function of a product discharge for the transverse fold product and are supported in a known manner in folding apparatus side walls 7 at both sides. The folding apparatuses 5 and 6 are arranged over one another so that the central axis of their drawing-in roller pairs 8 and 9 are in an imaginary vertical plane 10, and an imaginary horizontal plane 11 in the outlet gap of the drawing roller pair 4 is a plane of symmetry for them.

The outlet gap of the discharge roller pair 4 and the inlet gap of the drawing-in roller pairs 8 and 9 are connected with one another through a first transporting roller pair 12, a product deflector 13 and two sheet guides 14 and 15 which are mirror-symmetrical with respect to the imaginary plane 11 and have the same length. The geometry of the sheet guides 14 and 15 has a harmonic course, and in mathematical sense corresponds to a curve of a harmonic function. In the preferred embodiment the course of the sheet guides 14 and 15 corresponds to a portion of a sinusoid between two successive apexes and fulfills the function equation $$y = \frac{h}{2}\left(1 - \cos\frac{\pi}{a}x\right)$$

where h is the height of the inlet gap of the devices 5 and 6 over the outlet gap of the discharge roller pair 4, and a is the distance between the plane 10 of the center axes of the drawing-in roller pairs 8 and 9 and the central axis of the first transporting roller pair 12.

The transporting arrangement includes the first transporting roller pair 12, the product deflector 13, and the sheet guides 14 and 15 arranged in an advantageous manner together with the additional folding apparatuses 5 and 6 in a single frame 16. The side walls of the frame 16 extend in the plane of side walls of the folding apparatuses and rest on a movable chassis 17.

Further transporting roller pairs 18 and 19 are arranged in the sheet guides 14 and 15. With respect to the surface extension of the product stream, the transporting roller pairs 12, 18, 19 each include a lower and greater metal roller and an upper and smaller rubber roller. Both rollers are formed as driven rollers. Several metal rollers and several rubber rollers are supported on drive shafts in a rotation-fixed manner to be located opposite to one another and form several transporting roller pairs which are parallel to and in engagement with the product. The drive shaft which carries the rubber rollers is supported in a straight guide so that the rubber rollers can be adjusted in direction toward the metal rollers with respect to the thickness of the product. The drive shafts which carry the metal rollers of the transporting roller pairs 18 and 19 are also supported on both sides in the side walls of the frame 16 which extend in the plane of the folding apparatus side walls 7 and connected with the same by catches. One of the both frame side walls is formed as a transmission housing and accommodates a wheel train through which the main drive of the folding apparatus drives the transporting roller pairs 18 and 19.

The distance s in the transporting direction between the successive transporting roller pairs is approximately 10 mm shorter than the length of the product to be transported. The peripheral speed of the transporting roller pairs 18 and 19 and the drawing-in roller pairs 8 and 9 in the transporting direction are harmonically decreasing by corresponding transmission ratio in the wheel train. In the preferred embodiment the peripheral speeds of the transporting roller pairs 18, 19 and the drawing-in roller pairs 8, 9 with respect to the peripheral speed of the discharge roller pair 4 are maintained in the ratio approximately 1/1.3:1; 1/2:1; 1/3:1.

The wheel train for driving the transporting roller pairs 18 and 19 and the folding apparatuses 5 and 6 have each a switching transmission for alternatively transferring the transversely folded printed product to a third fold and for switching the subsequent folds without a proceeding part of the product stream in synchronism with the printing machine.

The sheet guides 14 and 15 each are composed of a lower and an upper guiding grid 20 and 21 with guiding rails 22 extending in the transporting direction. The width b of a gap between the upper and lower guiding rails amounts to approximately 3 mm. The guiding grid 20 of the sheet guide 14 is turnable downwardly while the guiding grid 21 of the sheet guide 15 is turnable upwardly, and therefore products which cause disturbances can be made available.

The product deflector 13 is composed of a turnable unit of two spaced guiding sheets 23 and 24. At the drive side the guiding sheets 23 and 24 are spaced by a driving web 25 on the end side of a shaft end 26 which is positively connected with a turning mechanism in the transmission housing of the drive side wall of the frame 16. At the other side they are spaced from one another by a spacer. The guiding sheets 23 and 24 are assembled in the unit by a screw 27 with a nut 28 cooperating with a pressure spring 29.

The arrangement of the folding apparatuses 5 and 6 for a second longitudinal fold follows the sheet guides 14 and 15 as well known and frequently used. Two stories are provided in the frame 16, on which the folding apparatuses 5 and 6 are transversely displaceably supported on rollers for compensating format differences. The surface heights of both stories are adjusted to the surface heights of the sheet guides 14 and 15.

Conveyor guides 30, abutments 31, folding cutters 32 and folding roller pairs 33 are components of the folding apparatus for the second longitudinal folds. They are provided for operation between the folding apparatuses 5 and 6 and the inventive transporting device for transferring the transversely folded printed products to a second longitudinal fold (third fold). The transporting arrangement in accordance with the shown embodiment has also a second product deflector 34, a curved sheet guide 35, a conveyor guide 36, a vane wheel 37 and a conveyor band 38. It provides a discharge of the transversely folded product (second fold) to the product stream by means of the product deflector 34 by switching manually or automatically. An automatic switching over to the discharge of the second fold operates so that in the case of failure of one or two folding apparatuses 5 and 6, without a machine stop the printing machine can be led around and subsequently the transfer of the transversely folded printing products to the third fold and the folding itself can be switched in synchronism with the printing machine.

The frame 16 can be disengaged from the side walls 7 of the folding apparatus and removed with the movable chassis 17 to the abutments 39. This will provide access to the arrangement for the second fold.

The transversely folded printed products are taken from the folding cylinder 2 by the turnable discharge tongues 3, engaged by the discharge roller pair 4 and transferred by the first transporting roller 12 to the product deflector 13. The product deflector 13 applies the products alternatingly through the sheet guides 14 and 15 to the folding apparatuses 5 and 6 for the second longitudinal fold.

Since the product stream entering the product deflector 13 has gaps between the individual products of approximately a product length, therefore due to the alternative operation of the product deflector 13, the product streams which run into the sheet guide 14 and 15 have gaps between the individual products of approximately three product lengths. This increases the front edge distance between two successive products to approximately four product lengths, and the folding apparatuses 5 and 6 are loaded with a half product quantity per time unit. Under the influence of the speed steps of the transporting roller pairs 18 and 19 and the drawing-in roller pairs 8 and 9, the speed of the product is harmonically decreasing, so that the product is supplied to the folding apparatuses 5 and 6 with approximately one-third of their initial speed during entering in the sheet guides 14 and 15. The curve between the individual products during entering the folding apparatuses 5 and 6 is reduced to approximately one-third the product length, and the front edge distance between two products successively located in the conveyor guide 30 of the folding apparatuses 5 and 6 amounts now to approximately 4/3 product length.

Conveyor guides 30 and the folding cutters 32 are driven synchronously in the folding apparatuses 5 and 6 respectively and so that the folding cutters 32 exactly reaches the plane of the product stream on which the product is set and then performs the folding step when the product reaches the abutments 31. The advantage of the inventive transporting arrangement is that the products are supplied with high position accuracy and without mechanical loading of the folding apparatuses 5 and 6. Therefore the abutments 31 in connection with the conveyor guides 30 have only a secondary importance for orienting of the product, and when the produced fold of the product reaches the abutment 31 further mechanical loads of the product by the conveyor guide 30 are avoided, which is especially important for sensitive products.

During the rotation of the folding cutters a zero phase angle with respect to the product front edge of the product stream in the conveyor guide 30 is adjustable. It is adjusted so that when the folding cutters 32 during their reverse are located in the plane of the product stream, a distance of 10–15 mm is provided between the folding cutters 32 and the front edge of the next product.

When however due to a disturbance in one of the folding apparatuses 5 and 6 it is necessary or desirable to discharge the transversely folded printed product without a third fold, this is achieved by operation of the product deflector 34 in cooperation with the curved sheet guide 35, the conveyor guide 36, the vane wheel 37 and the conveyor band 38. In the case of a disturbance it is possible switch over first to the position of the second fold and then, without stopping the machine, to run the printing machine at a lower speed adjusted to a preprocessing speed of a single folding apparatus 5, 6 and simultaneously provide the speed reduction in the sheet guides 14 and 15 by a switching over of the switching transmission in the wheel train for driving the transporting roller pair 18 and 19.

In accordance with an especially advantageous feature of the present invention the folding apparatuses 5 and 6 are arranged mirror-symmetrically in a stack so that their height is substantially smaller than the floor height of the product discharge of the transverse folding device 1. Therefore, in an optimal manner a free space for accommodating a position of second fold and a driveable chassis 17 for the frame is provided.

It will be understood that each of the elements described above, or two or more together, may also find a useful application in other types of constructions differing from the types described above.

While the invention has been illustrated and described as embodied in a transporting arrangement for transferring transversely folded printed products to a third fold, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An apparatus for transferring transversely folded printed products to a third fold, comprising means for providing a first longitudinal fold; subsequently arranged means for forming a transverse fold and having an outlet gap; two devices each for forming a third fold, located above the other and each having an inlet gap; two drawing-in roller pairs each associated with a respective one of said devices, each of said roller paris having a central axis located in an imaginary vertical plane, said inlet gaps of said devices for forming a third fold and said outlet gap of said means for forming a transverse fold being arranged relative to one another so that an imaginary horizontal plane extending through said outlet gap is simultaneously a plane of symmetry for said inlet gaps; means for connecting said outlet gap with said inlet gaps and including a first transporting roller pair, a product deflector and two mirror-symmetrical sheet guides of a same length, each of said sheet guides being associated with one of said devices, said sheet guides having a harmonic course and being each provided with two further transporting roller pairs arranged so that a distance between said further transporting roller pairs and a distance between a last one of said further transporting roller pairs and said drawing-in roller pairs is smaller than the length of a product to be folded, said further transporting roller pairs and said drawing-in roller pairs having speeds which harmonically decrease in a transporting direction.

2. An apparatus as defined in claim 1, wherein said sheet guides have a geometry corresponding to a course of a sinusoid portion between two successive apexes described by a function equation $$y = \frac{h}{2}\left(1 - \cos\frac{\pi}{a}x\right)$$

wherein h is a height of the inlet gap of said devices for forming a third fold over the outlet gap of said means for forming transverse folds, a is the distance between said vertical plane of said central axis of said drawing-in roller pairs of said devices and central axis of said first transporting roller pair.

3. An apparatus as defined in claim 1, wherein said sheet guides each having a second and a third transporting roller pair, said second transporting roller pair, said third transporting roller pair and said drawing-in roller pair having circumferential speeds in a substantially the following ratio 1/1.3:1, 1/2:1 1/3:1 with reference to a circumferential speed of said first transporting roller pair.

4. An apparatus as defined in claim 1, wherein each of said sheet guides has an upper and a lower guiding grid with guiding rails extending in a transporting direction so as to form between said upper and lower guiding grids a gap with a width greater than a thickness of a stream of the product to be folded.

5. An apparatus as defined in claim 4, wherein said guiding grids are turnable.

6. An apparatus as defined in claim 1, wherein one of said guiding grids is turnable upwardly while the other of said guiding grids is turnable downwardly.

7. An apparatus as defined in claim 1; and further comprising a product deflector for subdividing a product stream into two partial streams, said product deflector being formed as a turnable unit which includes two spaced guiding sheets and a pressure spring applying a pressure force against which said unit is yieldable.

8. An apparatus as defined in claim 1, wherein said means for forming a first longitudinal fold include a folding funnel.

* * * * *